US008864061B2

(12) United States Patent
Wojcik et al.

(10) Patent No.: US 8,864,061 B2
(45) **Date of Patent: *Oct. 21, 2014**

(54) CENTER/SURFACE REWINDER AND WINDER

(75) Inventors: Steven James Wojcik, Little Chute, WI (US); Dennis Marvin Jobs, Appleton, WI (US); Kenneth Allen Pigsley, Greenville, WI (US); James Leo Baggot, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/608,580

(22) Filed: Sep. 10, 2012

(65) Prior Publication Data

US 2012/0325954 A1 Dec. 27, 2012

Related U.S. Application Data

(63) Continuation of application No. 11/931,066, filed on Oct. 31, 2007, now Pat. No. 8,262,011, which is a continuation of application No. 10/085,813, filed on Feb. 28, 2002, now Pat. No. 8,210,462.

(51) Int. Cl.

| | |
|---|---|
| ***B65H 19/30*** | (2006.01) |
| ***B65H 67/04*** | (2006.01) |
| ***B65H 19/29*** | (2006.01) |
| ***B65H 19/22*** | (2006.01) |
| ***B65H 18/26*** | (2006.01) |

(52) U.S. Cl.

CPC ..... *B65H 18/26* (2013.01); *B65H 19/305* (2013.01); *B65H 2513/10* (2013.01); *B65H 2515/31* (2013.01); *B65H 19/29* (2013.01); *B65H 2301/41468* (2013.01); *B65H 2406/32* (2013.01); *B65H 19/2276* (2013.01); *B65H 2515/34* (2013.01); *B65H 19/2207* (2013.01); *B65H 19/2238* (2013.01); *B65H 2406/33* (2013.01); *B65H 2515/32* (2013.01); *B65H 2301/44334* (2013.01); *B65H 2301/4148* (2013.01); *B65H 2401/1121* (2013.01)

USPC ..... 242/533.7; 242/541.1; 242/541.3

(58) Field of Classification Search

CPC ..... B65H 16/00; B65H 18/08; B65H 19/22; B65H 19/30; B65H 18/22; B65H 18/26; B65H 18/14; B65H 20/10; B65H 19/29; B65H 19/2207; B65H 19/305; B65H 2301/41468; B65H 2301/41814; B65H 2301/41812; B65H 2406/33; B65H 2301/44336; B65H 19/2238

USPC ..... 242/525, 525.4, 530, 531, 532.2, 532.3, 242/533, 533.7, 535.1, 535.4, 541.1, 541.2, 242/541.3, 541.4, 541.5, 542, 542.4

See application file for complete search history.

(56) References Cited

U.S. PATENT DOCUMENTS 125,597 A * 4/1872 Mayall ..... 242/530.2
1,648,990 A * 11/1927 Little ..... 242/530

(Continued)

*Primary Examiner* — William A Rivera
(74) *Attorney, Agent, or Firm* — Dority & Manning, P.A.

(57) ABSTRACT

A winder for winding a web to produce a rolled product is provided. The winder includes a web transport apparatus that is used for conveying the web. Also included in one exemplary embodiment is a plurality of independent winding modules. The winding modules are independently positioned to independently engage the web as the web is conveyed by the web transport apparatus. The winding modules may be configured to wind the web to form a rolled product by center winding, surface winding, and combinations of center and surface winding. The winding modules are structurally and operationally independent of one another where if one module is disabled, another may still operate to produce the rolled product without shutting down the winder.

17 Claims, 14 Drawing Sheets

(56) References Cited

U.S. PATENT DOCUMENTS

| | | | | | |
|---|---|---|---|---|---|
| 1,894,253 | A | * | 1/1933 | McCarthy et al. | 242/521 |
| 2,326,173 | A | * | 8/1943 | Russell | 242/422.8 |
| 3,157,371 | A | * | 11/1964 | Billingsley | 242/530 |
| 3,869,095 | A | * | 3/1975 | Diltz | 242/531 |
| 4,034,928 | A | * | 7/1977 | McDonald et al. | 242/528 |
| 4,133,495 | A | * | 1/1979 | Dowd | 242/532.2 |
| 4,139,164 | A | * | 2/1979 | Alfio | 242/530 |
| 4,583,698 | A | * | 4/1986 | Nistri et al. | 242/524 |
| 4,930,711 | A | * | 6/1990 | Morizzo | 242/527 |
| 4,988,052 | A | * | 1/1991 | Urban | 242/524.1 |
| 5,379,964 | A | * | 1/1995 | Pretto et al. | 242/571.2 |
| 5,660,350 | A | * | 8/1997 | Byrne et al. | 242/533.4 |
| 8,262,011 | B2 | * | 9/2012 | Wojcik et al. | 242/525 |

* cited by examiner

CENTER/SURFACE REWINDER AND WINDER

RELATED APPLICATIONS

The present application claims priority to and is a continuation application of U.S. patent application Ser. No. 11/931,066, filed on Oct. 31, 2007 now U.S. Pat. No. 8,262,011, which claims priority to and is a continuation of U.S. patent application Ser. No. 10/085,813, filed on Feb. 28, 2002 now U.S. Pat. No. 8,210,462, which are both incorporated herein by reference.

BACKGROUND

Winders are machines that roll lengths of paper, commonly known as paper webs, into rolls. These machines are capable of rolling lengths of web into rolls at high speeds through an automated process. Turret winders are well known in the art. Conventional turret winders comprise a rotating turret assembly which support a plurality of mandrels for rotation about a turret axis. The mandrels travel in a circular path at a fixed distance from the turret axis. The mandrels engage hollow cores upon which a paper web can be wound. Typically, the paper web is unwound from a parent roll in a continuous fashion, and the turret winder rewinds the paper web onto the cores supported on the mandrels to provide individual, relatively small diameter logs. The rolled product log is then cut to designated lengths into the final product. Final products typically created by these machines and processes are toilet tissue rolls, paper toweling rolls, paper rolls, and the like.

The winding technique used in turret winders is known as center winding. In center winding, a mandrel is rotated in order to wind a web into a roll/log, either with or without a core. Typically, the core is mounted on a mandrel that rotates at high speeds at the beginning of a winding cycle and then slows down as the size of the rolled product being wound increases, in order to maintain a constant surface speed, approximately matching web speed. Center winders work well when the web that is being wound has a printed, textured, or slippery surface. Also, typically, center winders are preferable for efficiently producing soft-wound, higher bulk rolled products.

A second type of winding is known in the art as surface winding. A machine that uses the technique of surface winding is disclosed in U.S. Pat. No. 4,583,698. Typically, in surface winding, the web is wound onto the core via contact and friction developed with rotating rollers. A nip is typically formed between two or more co-acting roller systems. In surface winding, the core and the web that is wound around the core are usually driven by rotating rollers that operate at approximately the same speed as the web speed. Surface winding is preferable for efficiently producing hard-wound, lower bulk rolled products.

A problem found in both center and surface winders involves the winder shutting down when a condition such as a core load fault or a web break fault occurs. If a core on a turret winder, for instance, is not properly loaded onto the mandrel, the machine must shut down for the fault to be corrected. Similarly, a web break fault in a surface winder will also result in shutting the machine down. This results in a production loss and the immediate requirement to obtain repair services. The present invention provides a way of eliminating such problems by allowing the machine to continue to produce rolled product even though a fault condition has occurred. Additionally, the invention incorporates the advantages of both center and surface winding to produce rolled products having various characteristics by using either center winding, surface winding, or a combination of center and surface winding.

In the prior art, a winder is typically known as an apparatus that performs the very first wind of that web, generally forming what is known as a parent roll. A rewinder, on the other hand, is an apparatus that winds the web from the parent roll onto a roll that is essentially the finished product. It is to be noted, the prior art is not consistent in designating what is and is not a winder or rewinder. For instance, rewinders are sometimes called winders, and winders are sometimes referred to as rewinders.

SUMMARY

Objects and advantages of the invention will be set forth in part in the following description, or may be obvious from the description, or may be learned from practice of the present invention.

As used herein, "winder" is generic to a machine for forming a parent roll, and a machine (rewinder) for forming a roll/log from a parent roll. In other words, the word "winder" is broad enough to cover both a "winder" and "rewinder".

The present invention may include a web transport apparatus for conveying a web to a winder for winding the web to produce a rolled product. Also, a plurality of independent winding modules may be present. The winding modules are independently positioned to independently engage the web as it is conveyed by the web transport apparatus. The winding modules engage the web and wind the web to form a rolled product. The winding modules are configured to wind using center winding, surface winding, or a combination of center and surface winding. The winding modules are controlled and positioned independent of one another. Therefore, if one winding module is disabled another winding module may still operate to produce the rolled product without having to shut down the winder.

Also according to the present invention, a winder is disclosed as above where the plurality of independent winding modules may each have a core loading apparatus and a product stripping apparatus.

Also disclosed according to the present invention is a winder as set forth above where the plurality of independent winding modules each have a center driven mandrel onto which the web is wound to form the rolled product.

Also disclosed according to the present invention, is a method of producing a rolled product from a web. This method includes the step of conveying the web by a web transport apparatus. Another step in the method of the present invention may involve winding the web into the rolled product by using one or more winding modules. This may involve winding the web by one or more winding modules of the plurality of winding modules at any given time. The process that is used to wind the web may be center winding, surface winding, or a combination of both center and surface winding. The winding modules may act independently of one another to allow one or more winding modules to still wind the web to produce a rolled product without having to shut down the plurality of winding modules if any of the remaining winding modules fault or are disabled. The method according to the present invention also includes the step of transporting the rolled product from the winding module.

Another exemplary embodiment of the present invention may include a winder that is used for winding a web to produce a rolled product that has a web transport apparatus for conveying a web. This exemplary embodiment also has a plurality of independent winding modules mounted within a frame where each winding module has a positioning apparatus for moving the winding module into engagement with the web. Each winding module also has a mandrel that is rotated onto which the web is wound to form the rolled product. The winding modules are operationally independent of one another where if any of the winding modules are disabled, the remaining winding modules could continue to operate to produce the rolled product without having to shut down the winder. The rotational speed of the mandrel and the distance between the mandrel and the web transport apparatus may be controlled so as to produce a rolled product with desired characteristics. The winding modules are configured to wind the web by center winding, surface winding, and combinations of center and surface winding.

Another aspect of the present invention includes an exemplary embodiment of the winder as immediately discussed where each winding module may have a core loading apparatus for loading a core onto the mandrel. This exemplary embodiment also has a rolled product stripping apparatus for removing the rolled product from the winding module.

Yet another exemplary embodiment of the present invention includes a winder as substantially discussed above where each of the winding modules has a center winding means, a surface winding means, and a combination center and surface winding means.

DETAILED DESCRIPTION

Figure 1:
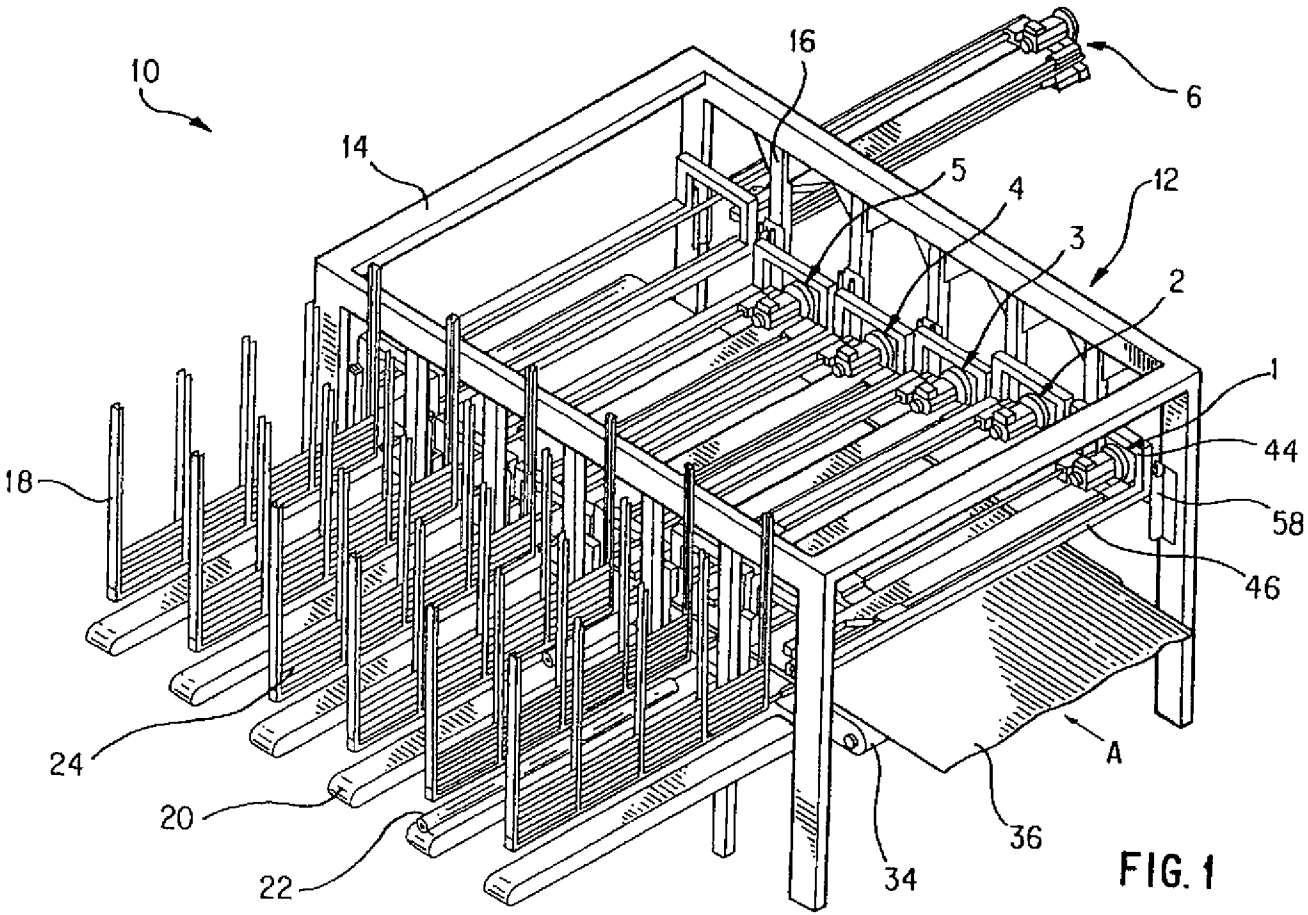
FIG. 1 is a perspective view of one exemplary embodiment of a winder of the present invention. This winder includes a plurality of independent winding modules that are positioned in the web direction with respect to one another and substantially contained within a modular frame.

Reference will now be made in detail to exemplary embodiments of the invention, one or more examples of which are illustrated in the drawings. Each example is provided by way of explanation of the invention, and not meant as a limitation of the invention. For example, features illustrated or described as part of one exemplary embodiment can be used with another exemplary embodiment to yield still a third exemplary embodiment. It is intended that the present invention include these and other modifications and variations.

A winder is provided in the present invention that is capable of winding web directly from a parent roll to form a rolled product. The winder may comprise a winding module that has a rotating mandrel that engages the leading edge of a moving web. Upon transfer of the leading edge of the web to the core, the winding mandrel is disengaged from the transport apparatus removing any nip pressure for the remainder of the wind. The web may be wound about the core through the rotation of the center driven mandrel. This type of winding is known as center winding. Additionally, the mandrel may be placed onto the web to form and maintain nip pressure between the winding mandrel and the web. The web may be wound about the core through the rotation of the surface driven mandrel. This type of winding is a form of surface winding. As such, the winding module of the present invention may wind web into a rolled product by center winding, surface winding, and combinations of center and surface winding. This allows for the production of rolled products with varying degrees of softness and hardness.

Also, the present invention provides for a winder that has a plurality of independent winding modules. Each individual winding module may wind the web such that if one or more modules are disabled, the remaining modules may continue to wind without interruption. This allows for operator servicing and routine maintenance or repairs of a module to be made without shutting down the winder. This configuration has particular advantages in that waste is eliminated and efficiency and speed of the production of the rolled product is improved.

The present invention makes use of a winding module 12 as shown in FIG. 1 in order to wind a web 36 and form a rolled product 22. Although a plurality of independent winding modules 12 may be used in the present invention to produce rolled products 22, the explanation of the functioning of only one winding module 12 is necessary in order to understand the building process of the rolled product 22.

Figure 5:
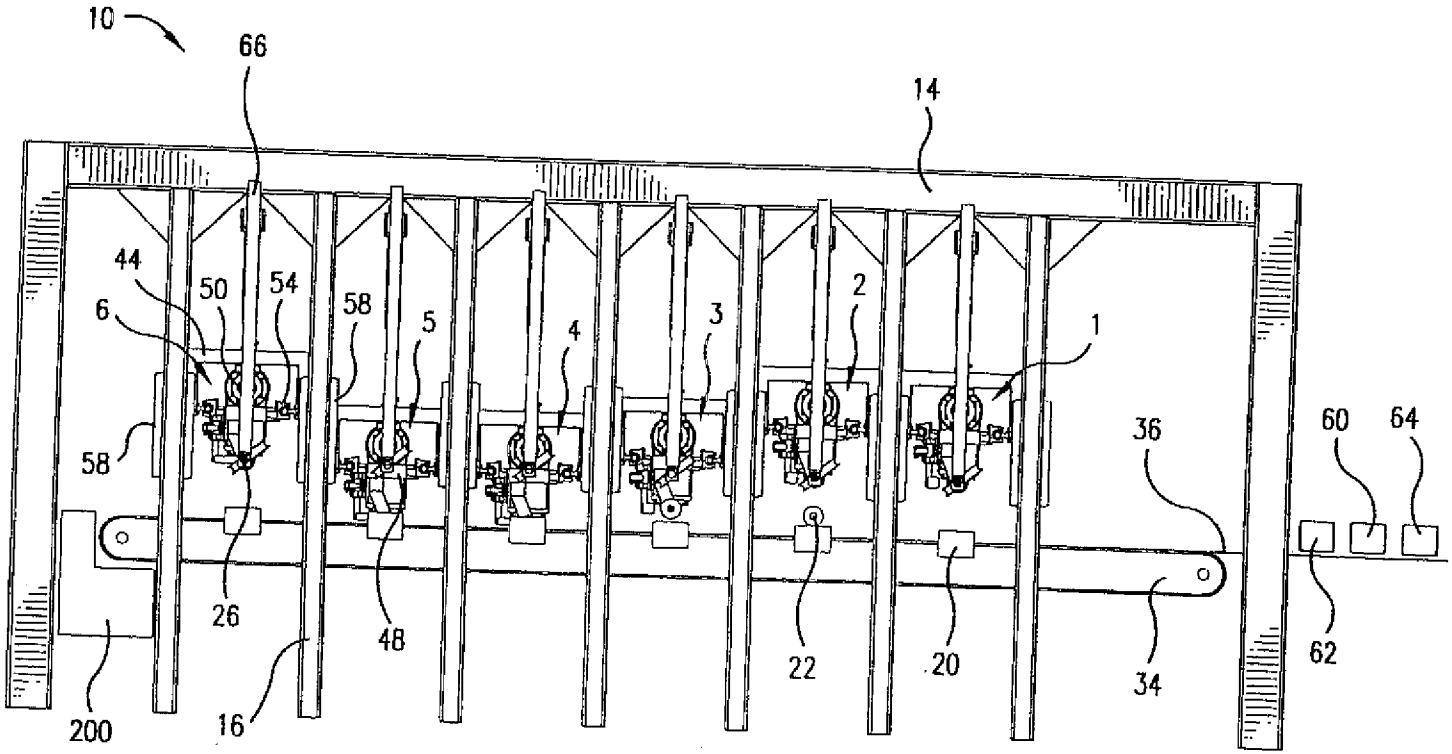
FIG. 5 is a side elevation view of an exemplary embodiment of a winder of the present invention. The drawing shows winding modules in addition to other modules, which perform functions on a web.

Referring to FIG. 5, a web 36 is transported by a web transport apparatus 34 as shown. The web 36 is cut to a predetermined length by use of, for instance, a cut-off module 60 may be configured as a pinch bar as is disclosed in U.S. Pat. No. 6,056,229. However, any other suitable way to cut the web 36 to a desired length may be employed. Additionally, the web 36 may be perforated by a perforation module 64 and have adhesive applied thereto by a transfer/tail seal adhesive applicator module 62 as also shown in FIG. 5. Additionally, in other exemplary embodiments, adhesion may be applied to the core 24 as opposed to the web 36. Referring back to FIG. 10, the mandrel 26 is accelerated so that the speed of the mandrel 26 matches the speed of the web 36. Mandrel 26 has a core 24 located thereon. The mandrel 26 is lowered into a ready to wind position and awaits the web 36. The core 24 is moved into contact with the leading edge of the web 36. The web 36 is then wound onto core 24 and is attached to core 24 by, for instance, the adhesive previously applied or and by the contact between the core 24 and the web 36.

Figure 11:
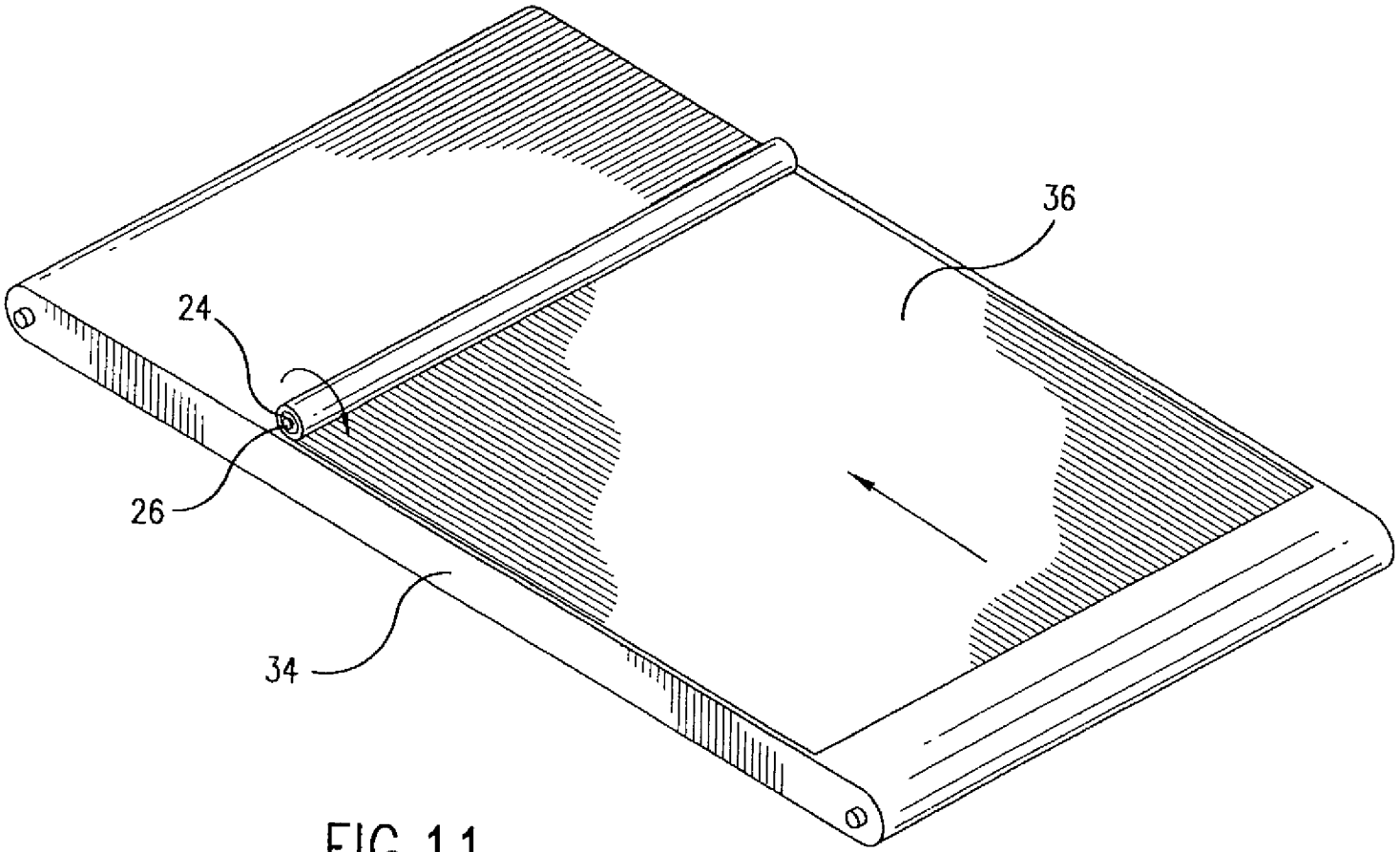
FIG. 11 is a perspective view of a rotating mandrel and core that are winding a web.

FIG. 11 shows the web 36 being wound onto the core 24. The winding of the web 36 onto core 24 may be controlled by the pressing of the core 24 onto the web transport apparatus 34 to form a nip. The magnitude with which the core 24 is pressed onto the web transport apparatus 34 creates a nip pressure that can control the winding of the web 36 onto the core 24. Additionally, the incoming tension of the web 36 can be controlled in order to effect the winding of the web 36 onto the core 24. Another control that is possible to wind the web 36 onto the core 24 involves the torque of the mandrel 26. Varying the torque on the mandrel 26 will cause a variance in the winding of the web 36 onto the core 24. All three of these types of winding controls, "nip, tension, and torque differential", can be employed in the present invention. Also, the winding of the web 36 may be affected by using simply one or two of these controls. The present invention therefore allows for any combination of winding controls to be employed in order to wind the web 36.

If not done before, the web 36 may be cut once the desired length of web 36 has been rolled onto the core 24. At this point, the leading edge of the next web 36 will be moved by the web transport apparatus 34 into contact with another winding module 12.

Figure 2:
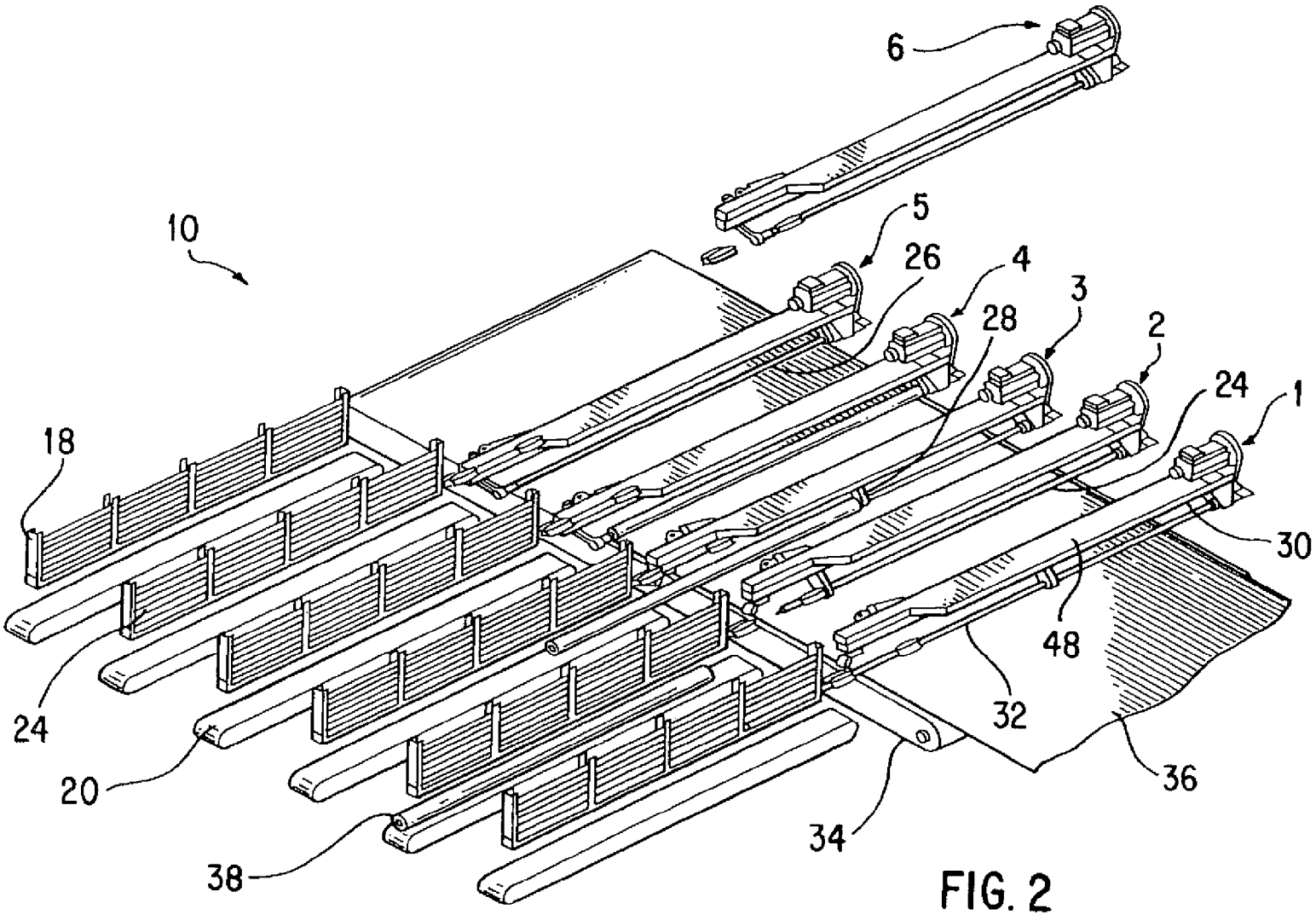
FIG. 2 is a perspective view of an exemplary embodiment of a winder of the present invention. This drawing shows a plurality of independent winding modules, which are performing the various functions of a log winding cycle.
Figure 10:
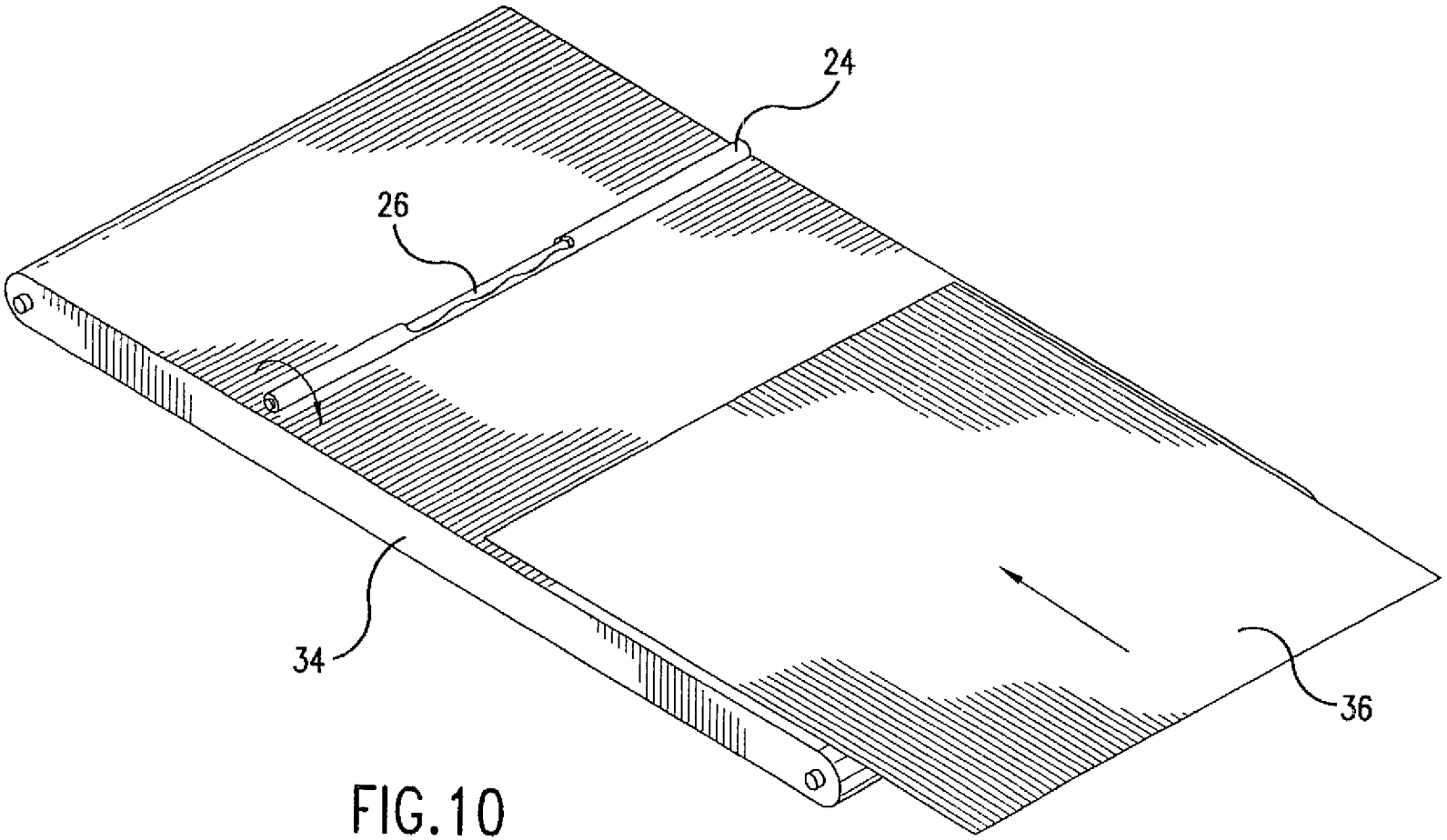
FIG. 10 is a perspective view of a web being transported by a web transport apparatus into proximity with a mandrel having a core.
Figure 12:
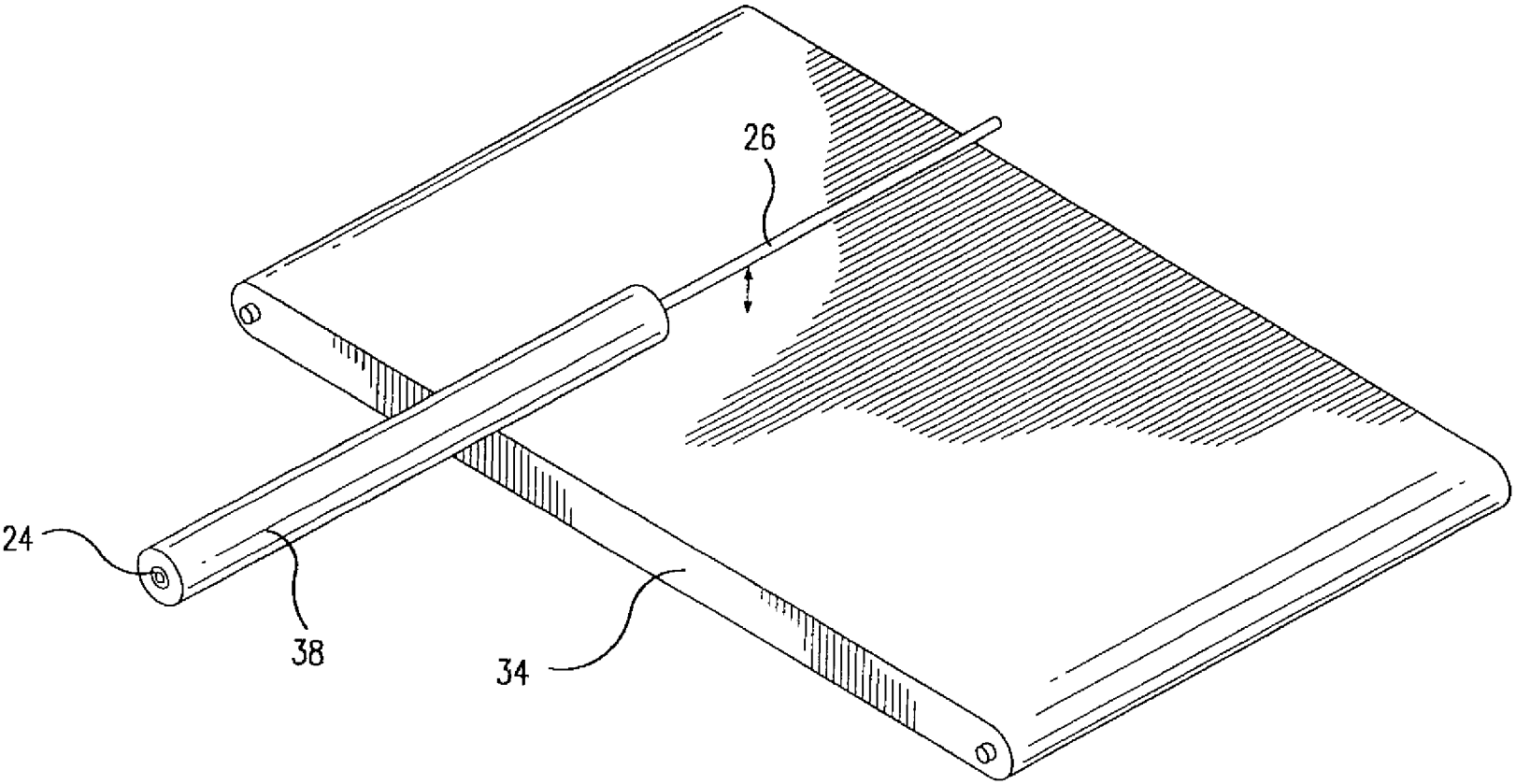
FIG. 12 is a perspective view of a rolled product with a core that is shown being stripped from a mandrel.

FIG. 12 shows the mandrel 26 being moved from a location immediately adjacent to the web transport apparatus 34 in FIG. 10 to a position slightly above the web transport apparatus 34. The wound length of web 36 is shown in FIG. 12 as being a rolled product 38 with a core 24. Now, a stripping function is carried out that moves the rolled product 38 with a core 24 off of the mandrel 26. This mechanism is shown as a product stripping apparatus 28 in FIG. 2. The rolled product 38 with a core 24 is moved onto a rolled product transport apparatus 20 as shown in FIGS. 1 and 2.

Figure 13:
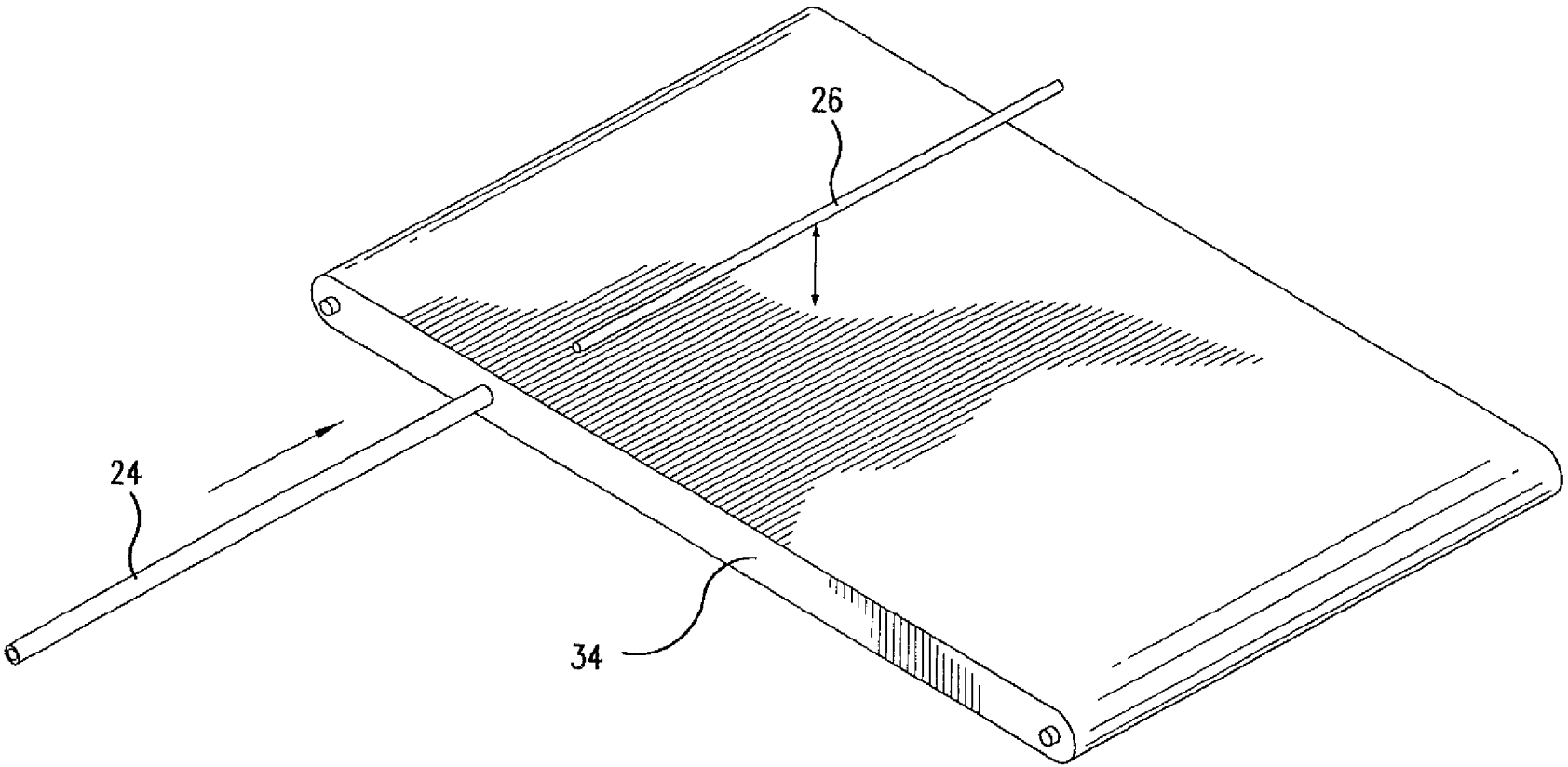
FIG. 13 is a perspective view of a mandrel that is in position to load a core.

Once the rolled product 38 with a core 24 is stripped from the mandrel 26, the mandrel 26 is moved into a core loading position as shown in FIG. 13. The product stripping apparatus 28 is shown in more detail in FIG. 2. Once the product stripping apparatus 28 finishes stripping the rolled product 38 with a core 24, the product stripping apparatus 28 is located at the end of the mandrel 26. This location acts to stabilize the mandrel 26 and prevent it from moving due to the cantilevered configuration of mandrel 26. In addition, the product stripping apparatus 28 helps to properly locate the end point of mandrel 26 for the loading of a core 24.

Figure 14:
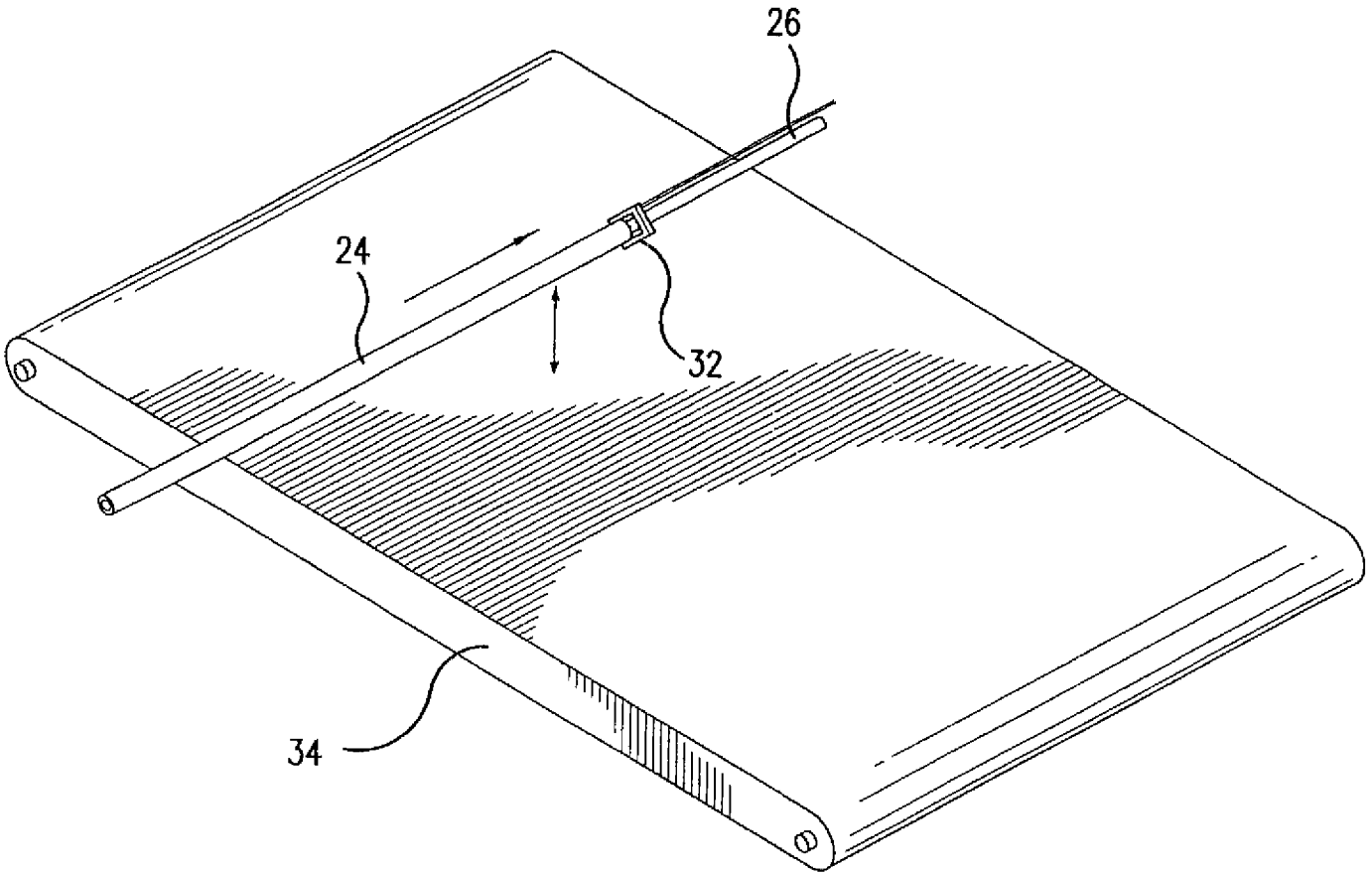
FIG. 14 is a perspective view that shows a core being loaded onto a mandrel via a core loading apparatus.

FIG. 14 shows a core 24 being loaded onto the mandrel 26. The loading of the core 24 is affected by a core loading apparatus 32. The product stripping apparatus may also serve as a core loading apparatus. The core loading apparatus 32 may be simply a frictional engagement between the core loading apparatus 32 and the core 24. However, the core loading apparatus 32 can be configured in other ways known in the art. In one embodiment of the present invention, once the core 24 is loaded, a cupping arm 70 (shown in FIG. 6) closes. Upon loading of the core 24 onto the mandrel 26, the mandrel 26 is moved into the ready to wind position as shown in FIG. 10. The cores 24 are located in a core supplying apparatus 18 as shown in FIGS. 1, 2, 3, and 4.

FIG. 1 shows an exemplary embodiment of a winder according to the invention as a "rewinder" 10 with a plurality of independent winding modules 12 arranged in a linear fashion with respect to one another. A frame 14 supports the plurality of independent winding modules 12. A web transport apparatus 34 is present which transports the web 36 for eventual contact with the plurality of independent winding modules 12. The frame 14 is composed of a plurality of posts 16 onto which the plurality of independent winding modules 12 are slidably engaged and supported. The frame 14 may also be comprised of modular frame sections that would engage each other to form a rigid structure. The number of modular frame sections would coincide with number of winding modules utilized.

Situated adjacent to the frame 14 are a series of core supplying apparatuses 18. A plurality of cores 24 may be included within each core supplying apparatus 18. These cores 24 may be used by the plurality of independent winding modules 12 to form rolled products 22. Once formed, the rolled products 22 may be removed from the plurality of independent winding modules 12 and placed onto a rolled product transport apparatus 20. The rolled product transport apparatus 20 is located proximate to the frame 14 and web transport apparatus 34.

FIG. 2 shows a rewinder 10 as substantially disclosed in FIG. 1 but having the frame 14 and other parts removed for clarity. In this exemplary embodiment, the plurality of independent winding modules 12 are composed of six winding modules 1-6. However, it is to be understood that the present invention includes exemplary embodiments having any number of independent winding modules 12 being other than six in number, for instance only one winding module 12 may be used in another exemplary embodiment.

Each winding module 1-6 is shown performing a different function. Winding module 1 is shown in the process of loading a core 24 thereon. The plurality of independent winding modules 12 are provided with a core loading apparatus for placing a core 24 onto a mandrel 26 of the plurality of independent winding modules 12. Any number of variations of a core loading apparatus may be utilized in other exemplary embodiments of the present invention. For instance, the core loading apparatus may be a combination of a rod that extends into the core supplying apparatus 18 and pushes a core 24 partially onto the mandrel 26 and a mechanism attached to the linear actuator of the product stripping apparatus 28 that frictionally engages and pulls the core 24 the remaining distance onto the mandrel 26. As shown in FIG. 2, winding module 1 is in the process of pulling a core 24 from the core supplying apparatus 18 and placing the core 24 on mandrel 26.

Winding module 2 is shown as having removed the rolled product 22 from its mandrel 26. The rolled product 22 is placed onto a rolled product transport apparatus 20. In this case, the rolled product 22 is a rolled product with a core 38. Such a rolled product with a core 38 is a rolled product 22 that is formed by having the web 36 being spirally wrapped around a core 24. It is to be understood that the rolled product 22 may also be a rolled product that does not have a core 24 and instead is simply a solid roll of wound web 36. It may also be the case that the rolled product 22 formed by the present invention does not include a core 24, but has a cavity in the center of the rolled product 22. Various configurations of rolled product 22 may thus be formed in accordance with the present invention.

Each of the plurality of independent winding modules 12 is provided with a product stripping apparatus 28 that is used to remove the rolled product 22 from the winding modules 1-6. Winding module 3 is shown as being in the process of stripping a rolled product 22 from the winding module 3. The product stripping apparatus 28 is shown as being a flange which stabilizes the mandrel 26 and contacts an end of the rolled product 22 and pushes the rolled product 22 off of the mandrel 26. Also, the product stripping apparatus 28 helps locate the end of the mandrel 26 in the proper position for the loading of a core 24. The rolled product stripping apparatus 28 therefore is a mechanical apparatus that moves in the direction of the rolled product transport apparatus 20. The product stripping apparatus 28 may be configured differently in other exemplary embodiments of the invention.

The winding module 4 is shown as being in the process of winding the web 36 in order to form the rolled product 22. This winding process may be center winding, surface winding, or a combination of center and surface winding. These processes will be explained in greater detail below.

Winding module 5 is shown in a position where it is ready to wind the web 36 once the winding module 4 finishes winding the web 36 to produce a rolled product 22. In other words, winding module 5 is in a "ready to wind" position.

Winding module 6 is shown in FIG. 1 in a "racked out" position. It may be the case that winding module 6 has either faulted or is in need of routine maintenance and is therefore moved substantially out of frame 14 for access by maintenance or operations personnel. As such, winding module 6 is not in a position to wind the web 36 to produce rolled product 22, but the other five winding modules 1-5 are still able to function without interruption to produce the rolled product 22. By acting as individual winders, the plurality of independent winding modules 12 allow for uninterrupted production even when one or more of the winding modules becomes disabled.

Figure 4:
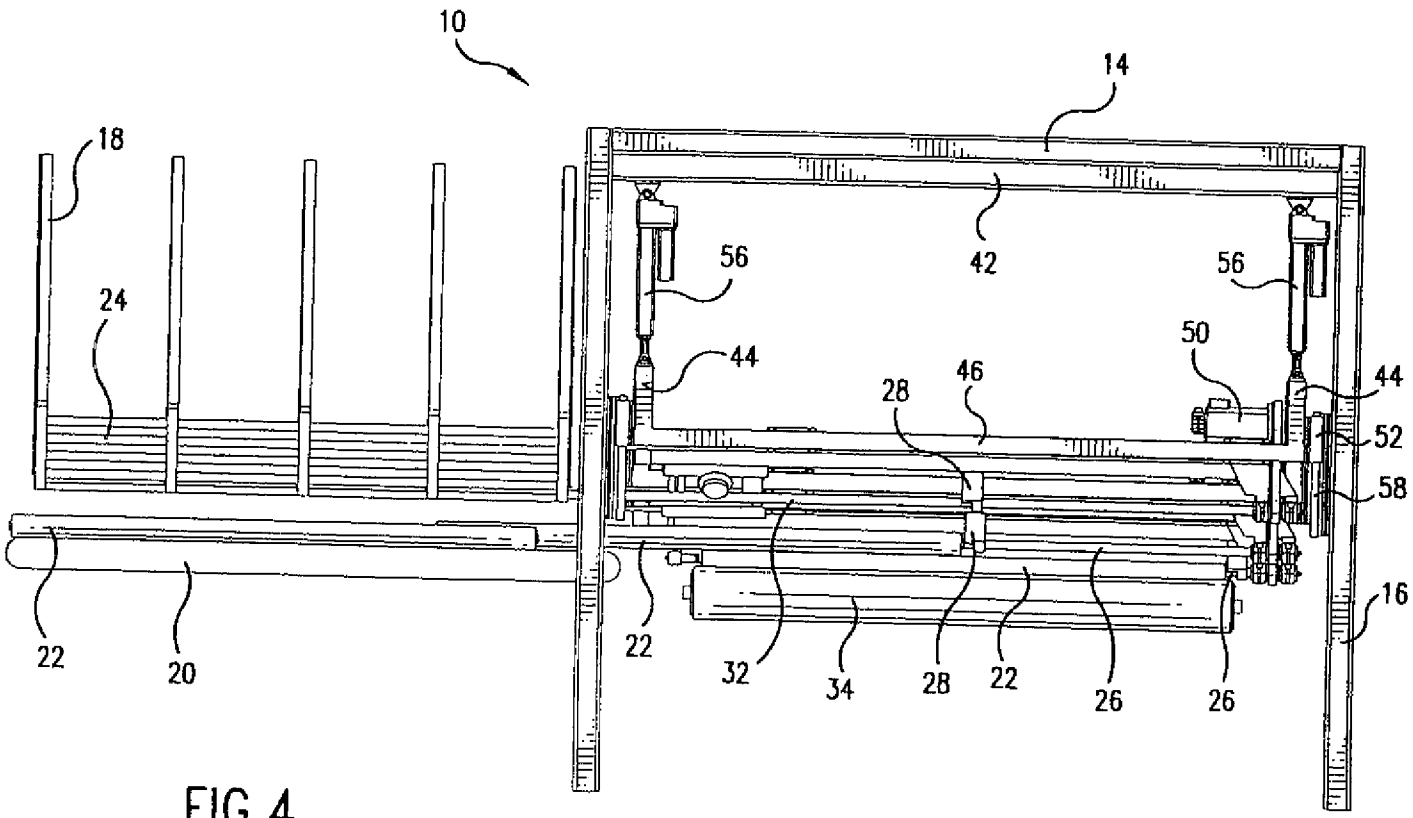
FIG. 4 is a front elevation view of an exemplary embodiment of a winder of the present invention. The drawing shows a plurality of independent winding modules linearly situated with respect to one another and performing the various functions of a log winding cycle.

Each winding module 12 may have a positioning apparatus 56 (FIG. 4). The positioning apparatus 56 moves the winding module perpendicularly with respect to web transport apparatus 34, and in and out of engagement with web 36. Although the modules 12 are shown as being moved in a substantially vertical direction, other exemplary embodiments of the invention may have the modules 12 moved horizontally or even rotated into position with respect to web 36. Other ways of positioning the modules 12 can be envisioned.

Therefore, each of the plurality of independent winding modules 12 may be a self-contained unit and may perform the functions as described with respect to the winding modules 1-6. Winding module 1 may load a core 24 onto the mandrel 26 if a core 24 is desired for the particular rolled product 22 being produced. Next, the winding module 1 may be linearly positioned so as to be in a "ready to wind" position. Further, the mandrel 26 may be rotated to a desired rotational speed and then positioned by the positioning apparatus 56 in order to initiate contact with the web 36. The rotational speed of the mandrel 26 and the position of the winding module 1 with respect to the web 36 may be controlled during the building of the rolled product 22. After completion of the wind, the position of the module 1 with respect to the web 36 will be varied so that the winding module 1 is in a position to effect removal of the rolled product 22. The rolled product 22 may be removed by the product stripping apparatus 28 such that the rolled product 22 is placed on the rolled product transport apparatus 20. Finally, the winding module 1 may be positioned such that it is capable of loading a core 24 onto the mandrel 26 if so desired. Again, if a coreless rolled product were to be produced as the rolled product 22, the step of loading a core 24 would be skipped. It is to be understood that other exemplary embodiments of the present invention may have the core 24 loading operation and the core 24 stripping operation occur in the same or different positions with regard to the mandrel 26.

The rewinder 10 of the present invention may form rolled products 22 that have varying characteristics by changing the type of winding process being utilized. The driven mandrel 26 allows for center winding of the web 36 in order to produce a low density, softer rolled product 22. The positioning apparatus 56 in combination with the web transport apparatus 34 allow for surface winding of the web 36 and the production of a high density, harder wound rolled product 22. Surface winding is induced by the contact between the core 24 and the web 36 to form a nip 68 (shown in FIG. 6) between the core 24 and the web transport apparatus 34. Once started, the nip 68 will be formed between the rolled product 22 as it is built and the web transport apparatus 34. As can be seen, the rewinder 10 of the present invention therefore allows for both center winding and surface winding in order to produce rolled products 22. In addition, a combination of center winding and surface winding may be utilized in order to produce a rolled product 22 having varying characteristics. For instance, winding of the web 36 may be affected in part by rotation of the mandrel 26 (center winding) and in part by nip pressure applied by the positioning apparatus 56 onto the web 36 (surface winding). Therefore, the rewinder 10 may include an exemplary embodiment that allows for center winding, surface winding, and any combination in between. Additionally, as an option to using a motor to control the mandrel speed/torque a braking device (not shown) on the winding modules 12 may be present in order to further control the surface and center winding procedures.

The plurality of independent winding modules 12 may be adjusted in order to accommodate for the building of the rolled product 22. For instance, if surface winding were desired, the pressure between the rolled product 22 as it is being built and the web transport apparatus 34 may be adjusted by the use of the positioning apparatus 56 during the building of the rolled product 22.

Utilizing a plurality of independent winding modules 12 allows for a rewinder 10 that is capable of simultaneously producing rolled product 22 having varying attributes. For instance, the rolled products 22 that are produced may be made such that they have different sheet counts. Also, the rewinder 10 can be run at both high and low cycle rates with the modules 12 being set up in the most efficient manner for the rolled product 22 being built. The winding modules 12 of the present invention may have winding controls specific to each module 12, with a common machine control. Real time changes may be made where different types of rolled products 22 are produced without having to significantly modify or stop the rewinder 10. Real time roll attributes can be measured and controlled. The present invention includes exemplary embodiments that are not limited to the cycle rate. The present invention is also capable of producing a wide spectrum of rolled products 22, and is not limited towards a specific width of the web 36. Also, the plurality of independent winding modules 12 can be designed in such a way that maintenance may be performed on any one or more of the winding modules 1-6 without having to interrupt operation, as previously discussed with winding module 6. A winding module 12 may be removed and worked on while the rest keep running. Further, having a plurality of independent winding modules 12 allows for an increase in the time intervals available for the core 24 loading functions and the rolled product 22 stripping functions. Allowing for an increase in these time intervals greatly reduces the occurrence of loading and stripping errors. Also, prior art apparatuses experiencing interruption of the winding operation will produce a rolled product 22 that is not complete. This waste along with the waste created by the changing of a parent roll or product format change will be reduced as a result of the rewinder 10 in accordance with the present invention. Waste may be removed from the rewinder 10 by use of a waste removal apparatus 200 (FIG. 5) as is known in the art.

Figure 3:
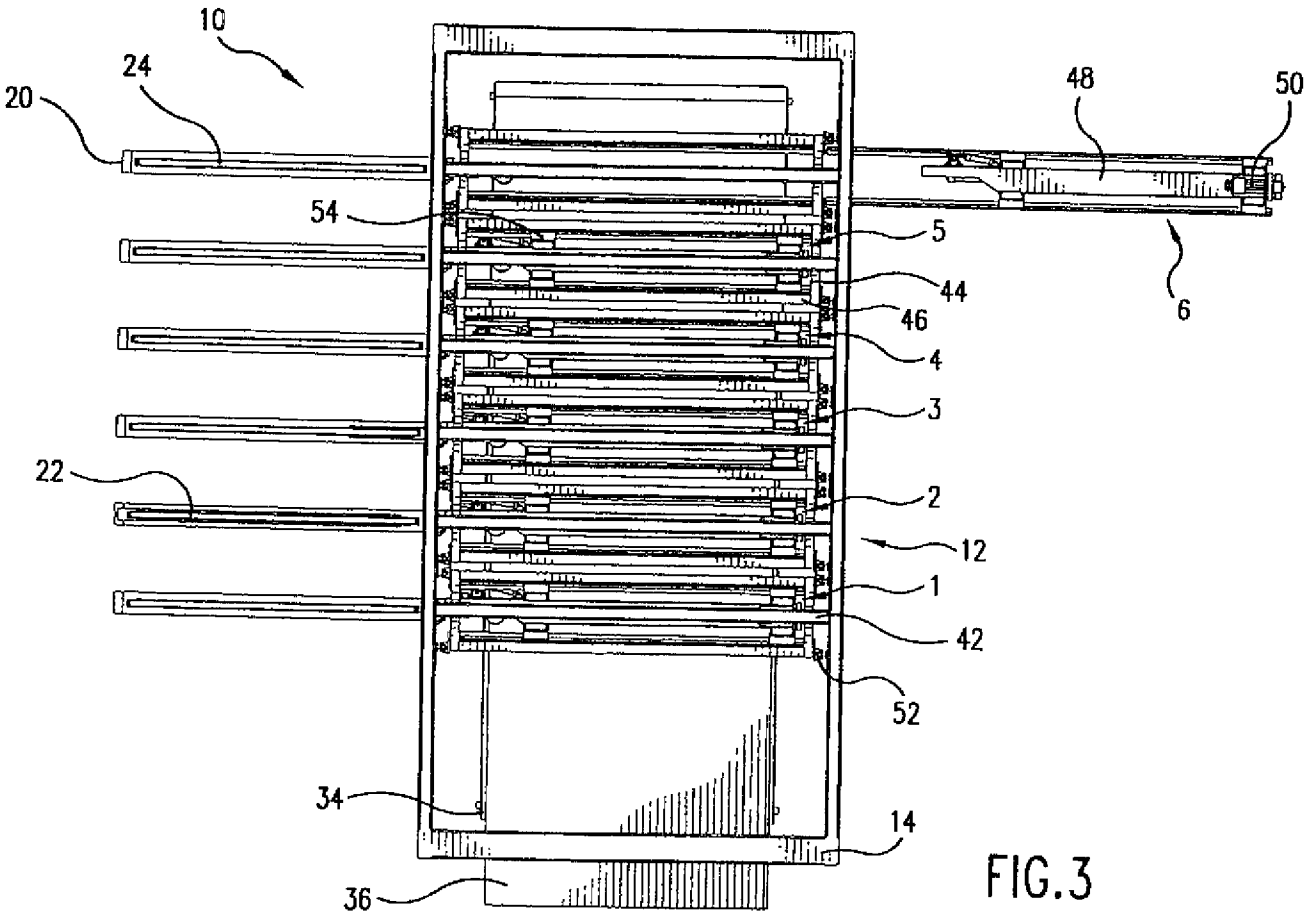
FIG. 3 is a plan view of an exemplary embodiment of a winder of the present invention. The drawing shows a plurality of independent winding modules linearly situated with respect to one another and performing the various functions of a log winding cycle.

FIG. 3 shows a rewinder 10 having a frame 14 disposed about a plurality of independent winding modules 12. The frame 14 has a plurality of cross members 42 transversing the ends of the frame 14. The positioning apparatus 56 that communicates with the winding modules 1-6 is engaged on one end to the cross members 42, as shown in FIG. 4. A vertical linear support member 44 is present on the plurality of independent winding modules 12 in order to provide an attachment mechanism for the positioning apparatus 56 and to provide for stability of the winding modules. The positioning apparatus 56 may be a driven roller screw actuator. However, other means of positioning the plurality of independent winding modules 12 may be utilized. The vertical support members 44 also may engage a vertical linear slide support 58 that is attached to posts 16 on frame 14. Such a connection may be of various configurations, for instance a linear bearing or a sliding rail connection. Such a connection is shown as a vertical linear slide 52 that rides within the vertical linear slide support 58 in FIG. 4.

Figure 6:
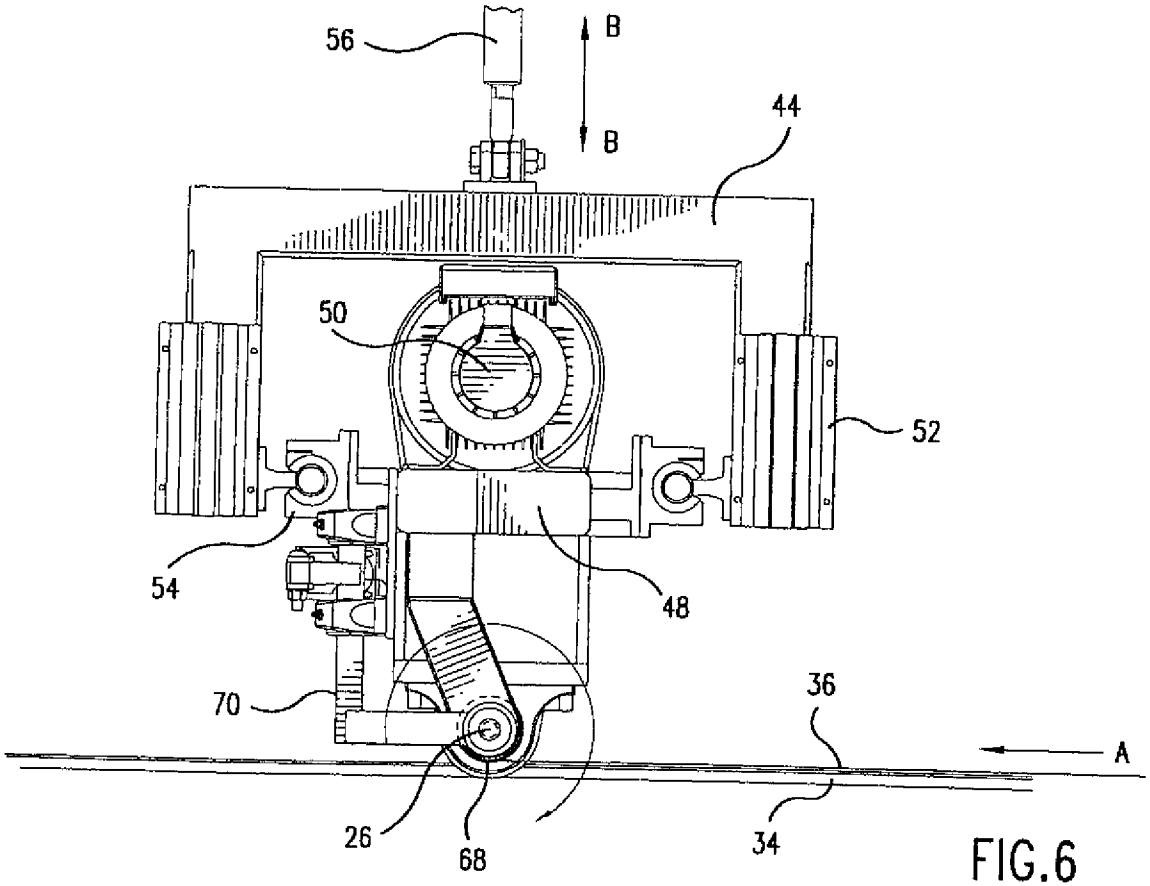
FIG. 6 is a side elevation view of an exemplary embodiment of an independent winding module in accordance with the present invention. The drawing shows the winding module engaging a web and forming a rolled product.

A horizontal linear support member 46 is also present in the plurality of independent winding modules 12. The horizontal linear support member 46 may communicate with a horizontal linear slide 54 (as shown in FIG. 6) to allow some or all of the plurality of independent winding modules 12 to be moved outside of the frame 14. The horizontal linear slide 54 may be a linear rail type connection. However, various configurations are envisioned under the present invention.

FIG. 6 shows a close up view of an exemplary embodiment of a winding module in accordance with the present invention. The servomotor 50 can be supported by the module frame 48 onto which a mandrel cupping arm 70 is configured. The mandrel cupping arm 70 is used to engage and support the end of the mandrel 26 opposite the drive during winding. As can be seen, the positioning apparatus 56 may move the winding module for engagement onto the web 36 as the web 36 is transported by the web transport apparatus 34. Doing so will produce a nip 68 at the point of contact between the mandrel 26 and the transport apparatus 34, with the web 36 thereafter being wound onto the mandrel 26 to produce a rolled product 22.

Figure 7:
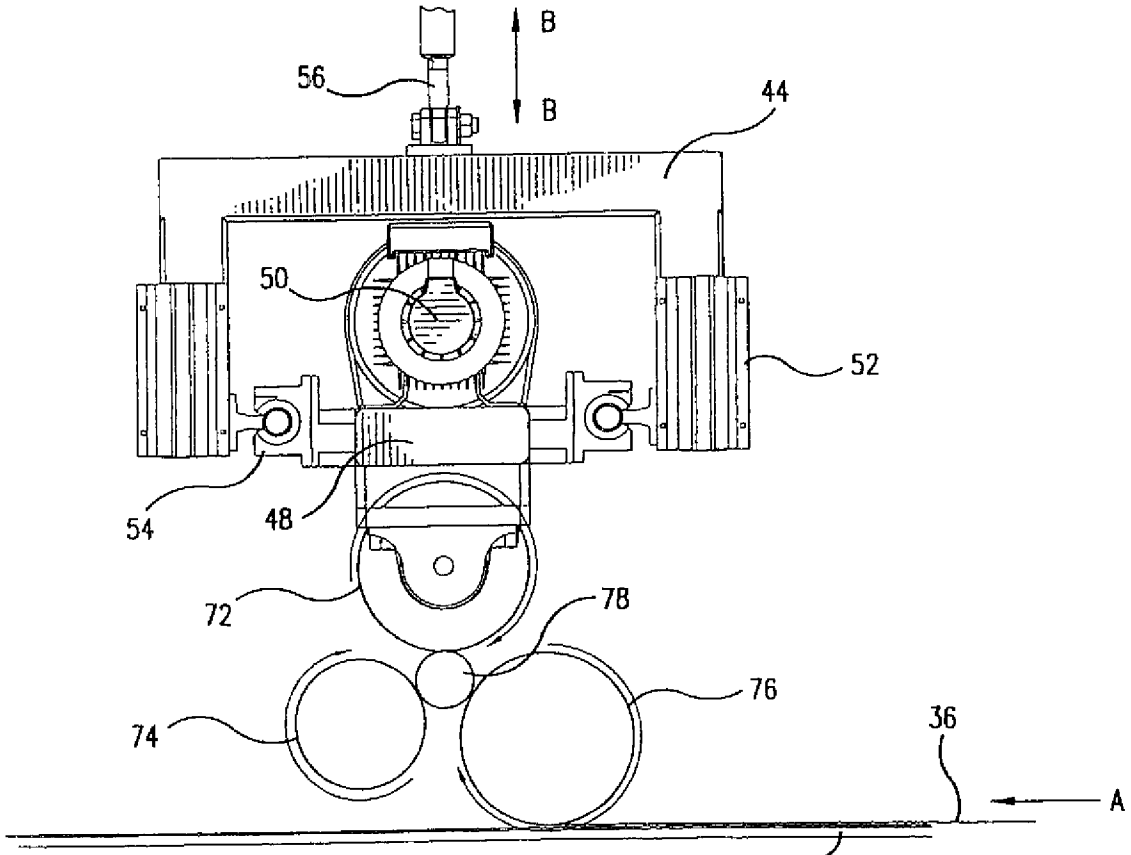
FIG. 7 is a side elevation view of an exemplary embodiment of a winding module in accordance with the present invention. The drawing shows the winding module using rolls to form a rolled product via surface winding only.

FIG. 7 shows another exemplary embodiment of a winder module in accordance with the present invention. The exemplary embodiment in FIG. 7 is substantially similar to the exemplary embodiment shown in FIG. 6 with the exception of having the winding process being a pure surface procedure. A drum roll 72 is located at approximately the same location as the mandrel 26 of FIG. 6. In addition, the exemplary embodiment shown in FIG. 7 also has another drum roll 74 along with a vacuum roll 76. In operation, the web 36 is conveyed by the web transport apparatus 34 in the direction of arrow A. The web transport apparatus 34 may be a vacuum conveyor or a vacuum roll. However, it is to be understood that a variety of web transport apparatus 34 may be utilized, and the present invention is not limited to one specific type. Another exemplary embodiment of the present invention employs a web transport apparatus 34 that is an electrostatic belt that uses an electrostatic charge to keep the web 36 on the belt. The vacuum roll 76 draws the web 36 from the web transport apparatus 34 and pulls it against the vacuum roll 76. The web 36 is then rotated around the vacuum roll 76 until it reaches a location approximately equal distance from the drum roll 72, drum roll 74, and vacuum roll 76. At such time, the web 36 is no longer pulled by the vacuum in the vacuum roll 76 and is thus able to be rolled into a rolled product 22 by way of surface winding by the drum roll 72, drum roll 74, and vacuum roll 76. The rolled product 22 that is formed in the exemplary embodiment shown in FIG. 7 is a coreless rolled product without a cavity 78. The winding module may also be modified such that more than or fewer than three rolls are used to achieve the surface winding process. Further, the production of the rolled product 22 having a core 24 or a coreless cavity in the rolled product 22 can be achieved in other exemplary embodiments using a similar configuration as shown in FIG. 7.

The plurality of winding modules 12 may also be modified such that additional improvements are realized. For instance, a tail sealing apparatus 30 may be included on the plurality of independent winding modules 12. As shown in FIG. 2, the tail sealing apparatus 30 is located on the underside of the plate 48. The tail sealing apparatus 30 may be a series of holes from which an adhesive is sprayed onto the rolled product 22 as the final lengths of the web 36 are rolled onto the rolled product 22. The adhesive causes the tailing end of the web 36 to be adhered to the rolled product 22. It is therefore possible to seal the tail of the rolled product 22 before being unloaded to the rolled product transport apparatus 20. Of course, it may also be possible to provide adhesive to the web 36 at a point other than at the plurality of independent winding modules 12. As stated, for example, adhesive may be applied by the tail sealing module 62 as shown in FIG. 5. Also, it may also be the case that sealing of the tail of the web 36 onto the rolled product 22 may be done offline, beyond the winder.

In order to get the web 36 onto the mandrel 26, the mandrel 26 as shown in FIG. 6, may be a vacuum supplied mandrel. Such a vacuum mandrel 26 will pull the web 36 onto the mandrel 26 by means of a vacuum supplied through all or parts of the vacuum mandrel 26. Other ways of assisting the transfer of the web 36 onto the mandrel 26 are also possible. For instance, an air blast may be provided under the surface of the web transport apparatus 34 or a taming apparatus may be placed under the web transport apparatus 34 to propel the web 36 into contact with the mandrel 26. Further, the positioning apparatus 56 may be used to push the winding module down onto the web 36 to effect the winding. Again, the rewinder 10 of the present invention is thus capable of producing a rolled product 22 which has a core, which is solid without a core or cavity therethrough, or which does not have a core but does have a cavity therethrough. Such a rolled product 22 that is produced without a core 24, yet having a cavity therethrough could be produced by using a vacuum supplied mandrel 26.

FIG. 5 shows an exemplary embodiment of a rewinder 10 that makes use of several modules upstream from the plurality of independent winding modules 12. For instance, a cut-off module 60 is utilized that severs the web 36 once a desired amount of web 36 is transported for the production of a rolled product 22. This severing creates a new leading edge for the next available winding module 1-6 to engage. However, it is to be understood that a cut-off module 60 may be utilized at locations immediately adjacent to or at the nip 68 of the plurality of independent winding modules 12. Also, FIG. 5 shows an adhesive application module 62 on the web transport apparatus 34. This adhesive application module 62 may be an apparatus for applying adhesive or an adhesive tape onto the web 36 in such a fashion that the adhesive would be applied to the tail end of the rolled product 22 sheet. The adhesive application module 62 may apply adhesive to the web 36 so that both the rolled product 22 will be sealed upon completion and the leading edge of the web 36 will have a source of adhesion to transfer to the core of the next successive module. A perforation module 64 is also provided in order to perforate the web 36 such that individual sheets may be more easily removed therefrom.

Also shown in FIG. 5 is a waste removal apparatus 200 for removing extra web 36 that results from faults such, as web breaks, and machine start ups. This waste is moved to the end of the web transfer apparatus 34 and then removed. The use of a plurality of individual modules 12 reduces the amount of waste because once a fault is detected, the affected module 12 is shut down before the rolled product is completely wound. The web is severed on the fly and a new leading edge is transferred to the next available module. Any waste is moved to the end of the web transfer apparatus 34 and then removed.

It is believed that using a web transport apparatus 34 that has a vacuum conveyor or a vacuum roll will aid in damping the mandrel 26 vibrations that occur during transfer of the web 36 onto the mandrel and also during the winding of the mandrel 26 to form a rolled product 22. Doing so will allow for higher machine speeds and hence improve the output of the rewinder 10.

Each of the winder modules 1-6 of the plurality of independent winding modules 12 do not rely on the successful operation of any of the other modules 1-6. This allows the rewinder 10 to operate whenever commonly occurring problems during the winding process arise. Such problems could include for instance web breaks, ballooned rolls, missed transfers, and core loading errors. The rewinder 10 therefore will not have to shut down whenever one or more of these problems occurs because the winding modules 1-6 can be programmed to sense a problem and work around the particular problem without shutting down. For instance, if a web break problem occurred, the rewinder 10 may perform a web cut by a cut-off module 60 and then initiate a new transfer sequence in order to start a new winding about the next available winding module 1-6. Any portion of the web 36 that was not wound would travel to the end of the web transport apparatus 34 where a waste removal apparatus 200 could be used to remove and transport the waste to a location remote from the rewinder 10. The waste removal apparatus 200 could be for instance an air conveying system. The winding module 1-6 whose winding cycle was interrupted due to the web break could then be positioned accordingly and initiate removal of the improperly formed rolled product 22. Subsequently, the winding module 1-6 could resume normal operation. During this entire time, the rewinder 10 would not have to shut down.

Another exemplary embodiment of the present invention involves the use of a slit web. Here, the web 36 is cut one or more times in the machine direction and each slit section is routed to a plurality of winding modules 12. It is therefore possible to wind the web 36 by two or more modules 12 at the same time.

Exemplary embodiments of the present invention can allow for the winding process to be performed at the back end of a tissue machine. In this way, the tissue web 36 could be directly converted to product sized rolls 22 which in turn would bypass the need to first wind a parent roll during the manufacturing and subsequent rewinding process. Still another exemplary embodiment of the present invention makes use of only a single winding module 12, instead of a plurality of winding modules 12.

The exemplary embodiment of the rewinder shown in FIG. 5 is one possible configuration for the movement of the plurality of independent winding modules 12. A positioning apparatus member 66 is present and is attached to the frame 14. The positioning apparatus member 66 extends down to a location proximate to the winding location of the web 36. The plurality of independent winding modules 12 are slidably engaged with the positioning apparatus member 66 so that the center, surface, or center/surface winding procedure can be accomplished. It is to be understood that alternative ways of mounting and sliding the plurality of independent winding modules 12 in a vertical direction can be accomplished by those skilled in the art. The plurality of independent winding modules 12 of FIG. 5 are arranged in a substantially linear direction. In addition, the web transport apparatus 34 is also linear in orientation at the location proximate to the plurality of independent winding modules 12. The embodiments depicted are of an orientation of the web transport device in a substantially horizontal plane. However, it should be realized that any orientation other than horizontal could be utilized. Furthermore, the embodiments depicted utilize modules that only engage one side of the web transport apparatus. It should be understood that a winder could be configured where the winding modules engage more than one side of the Web transport apparatus.

Figure 8:
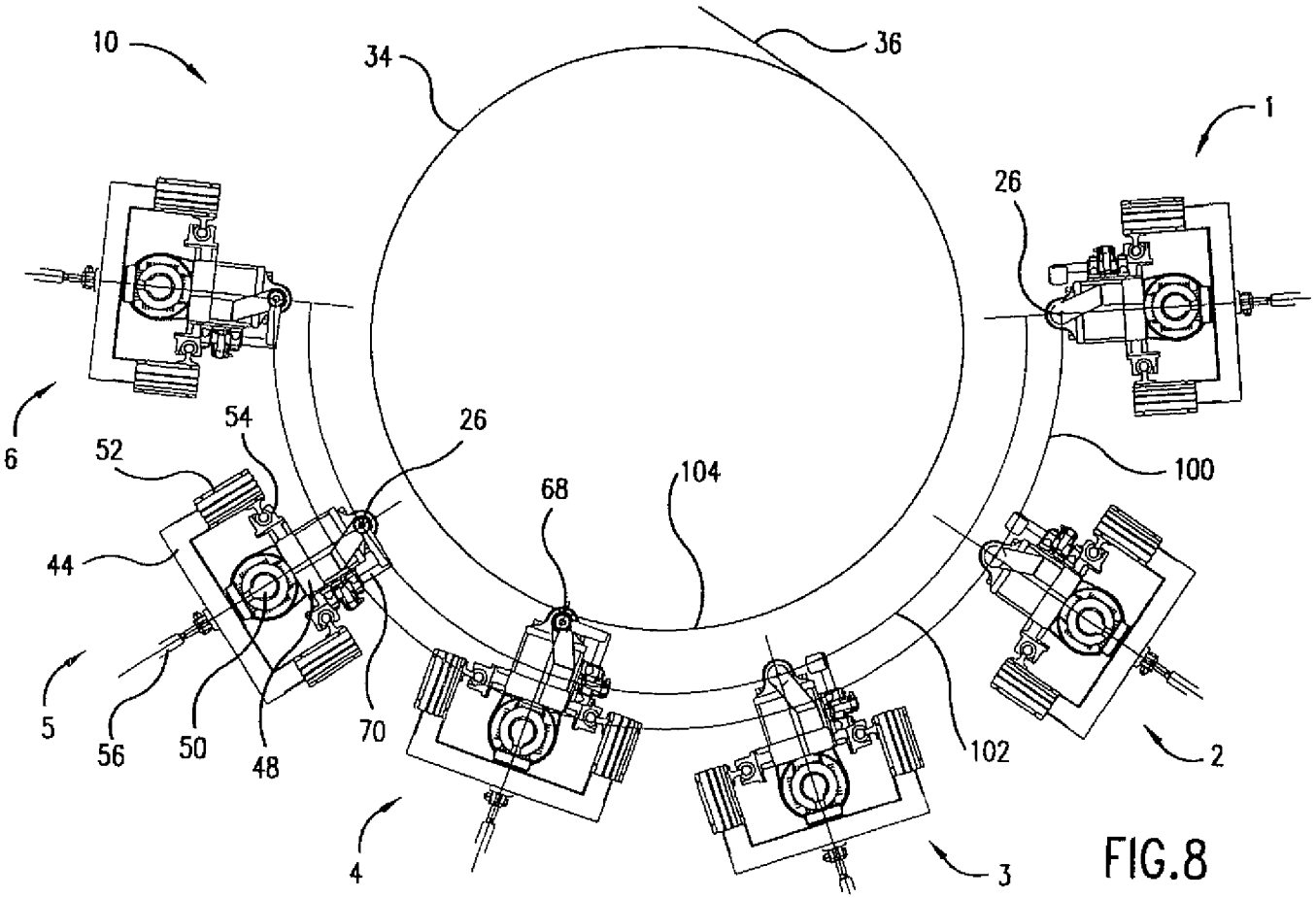
FIG. 8 is a side elevation of an exemplary embodiment of a winder in accordance with the present invention. The drawing shows a plurality of independent winding modules being radially situated with respect to one another and interacting with a circular web transport apparatus.

FIG. 8 shows an alternative configuration of both the web transport apparatus 34 and the plurality of independent winding modules 12. The exemplary embodiment shown in FIG. 8 is a plurality of winding modules 12 that are radially disposed with respect to one another, and a web transport apparatus 34 that is cylindrical in shape. The web transport apparatus 34 in this case can be, for instance, a vacuum roll. Each of the winding modules 1-6 are arranged about the web transport apparatus 34 such that the winding modules 1-6 are moved towards and away from the web transport apparatus 34 by the positioning apparatus 56.

The operation of the exemplary embodiment shown in FIG. 8 is substantially similar to that as previously discussed. Winding module 1 is shown in the process of loading a core 24. The mandrel 26 of winding module 1 has a distance from the center of the web transport apparatus 34 designated as a core loading position 100. Winding module 3 is shown in the process of stripping a rolled product 22. The center of the mandrel 26 of winding module 3 is located at a stripping position 102 from the center of the web transport apparatus 34. Winding module 4 is shown in the process of engaging the web 36 and winding the web 36 onto the core 24, that is loaded on the driven mandrel 26, to form a rolled product 22. A nip 68 is formed between the core 24, that is loaded on mandrel 26, and the web transport apparatus 34. The nip 68 is located at a winding position 104 at a distance from the center of the web transport apparatus 34.

Winding modules 2 and 6 are located at the core loading position 100. However, these modules may be positioned such that maintenance can be performed on them, or be in the "ready to wind" position. Module 5 is at the stripping position 102. However, module 5 may also be in the process of just completing the stripping of a rolled product 22.

Figure 9:
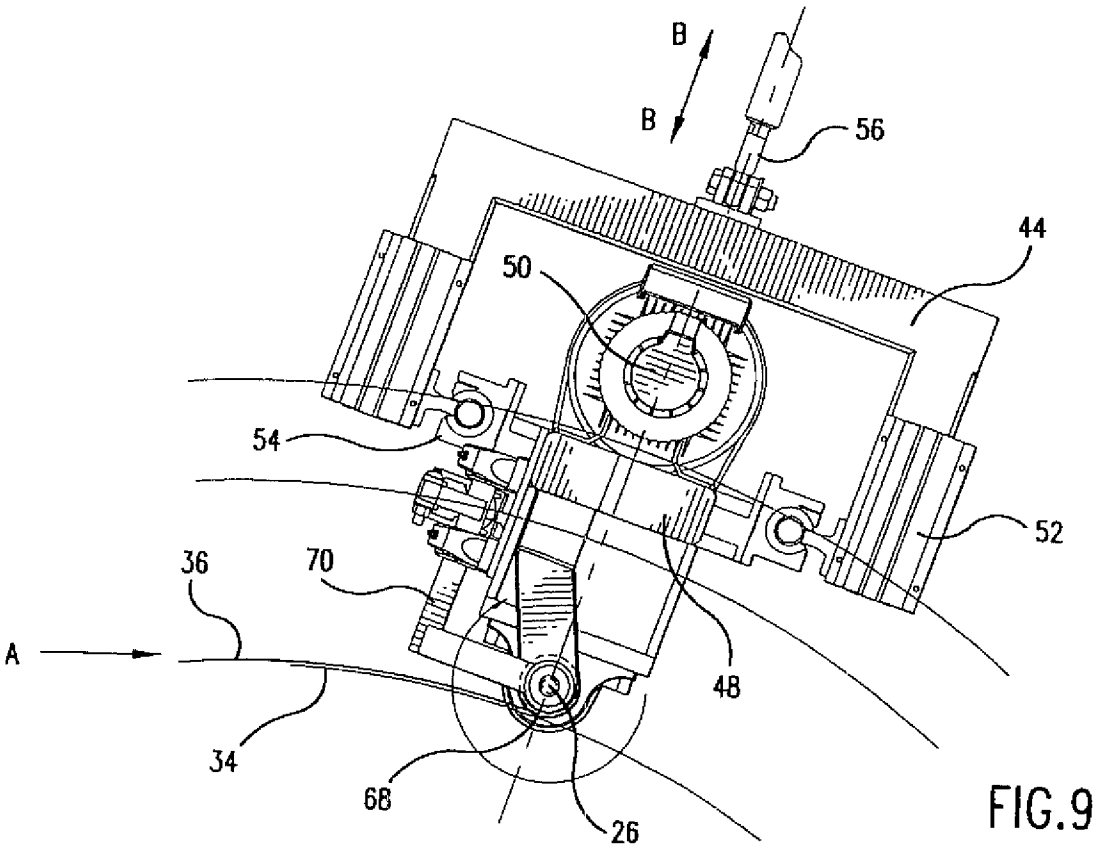
FIG. 9 is a side elevation view of an exemplary embodiment of an independent winding module in accordance with the present invention. The drawing shows a winding module that interacts with a circular web transport apparatus.

FIG. 9 discloses an exemplary embodiment of a winding module that is used in the configuration disclosed in FIG. 8. The winding module of FIG. 9 is substantially the same as the winding module shown in FIG. 6, although configured for a circular array configuration as opposed to a linear array configuration.

It should be understood that the invention includes various modifications that can be made to the exemplary embodiments of the center/surface rewinder/winder described herein as come within the scope of the appended claims and their equivalents. Further, it is to be understood that the term "winder" as used in the claims is broad enough to cover both a winder and a rewinder.

What is claimed is:

1. A process for unwinding a parent roll into multiple product rolls comprising:

unwinding a tissue web from a parent roll and conveying the tissue web on a web transport apparatus, wherein a plurality of winding modules are positioned adjacent to the web transport apparatus, each winding module containing a mandrel, wherein each mandrel is in operative association with a driving device for center driving and rotating the mandrel, the mandrels being consecutively positioned and fixed along the web transport apparatus;

positioning a first mandrel adjacent to the web transport apparatus for engaging a leading edge of the tissue web so as to initiate winding of the web onto the first mandrel;

after forming a first rolled product on the first mandrel, cutting the tissue web without interrupting the unwinding of the tissue web and the conveying of the tissue web on the web transport apparatus and thereby forming a new leading edge;

positioning a second mandrel adjacent to the web transport apparatus for engaging the new leading edge of the tissue web so as to initiate winding of the web onto the second mandrel and thereby forming a second rolled product on the second mandrel without interrupting the unwinding of the tissue web.

2. A process as defined in claim 1, wherein the web transport apparatus has a cylindrical shape and wherein the mandrels are radially disposed with respect to one another along the web transport apparatus.

3. A process as defined in claim 1, further comprising the steps of:

after forming the second rolled product on the second mandrel, cutting the tissue web without interrupting the unwinding of the tissue web and the conveying of the tissue web on the web transport apparatus to form a new leading edge; and positioning a third mandrel adjacent to the web transport apparatus for engaging the new leading edge of the tissue web so as to initiate winding of the web onto the third mandrel for forming a third rolled product.

4. A process as defined in claim 1, further comprising the step of placing a core onto the first mandrel prior to positioning the mandrel adjacent to the web transport apparatus so that the tissue web is wound onto the core.

5. A process as defined in claim 1, further comprising the steps of:

loading a core on the first mandrel and accelerating the mandrel to a desired rotation speed prior to engaging the leading edge of the tissue web;

positioning the mandrel to initiate contact between the rotating core and the tissue web; and stripping the first rolled product from the mandrel.

6. A process as defined in claim 1, wherein, in order to engage a leading edge of the tissue web, each mandrel is positioned adjacent to the web transport apparatus for forming a nip between the web transport apparatus and the mandrel.

7. A process as defined in claim 6, wherein after winding is initiated on the first mandrel, the position of the mandrel with respect to the web transport apparatus is adjusted by a positioning apparatus, the positioning apparatus being configured to move the mandrel towards and away from the web transport apparatus, the position of the mandrel being adjusted by the positioning apparatus for controlling a nip pressure between a rolled product being formed on the mandrel and the web transport apparatus in order to produce the rolled product with desired characteristics.

8. A process as defined in claim 1, wherein winding on each mandrel is carried out by using a combination of center winding and surface winding, center winding occurring by driving the mandrel and surface winding occurring by positioning the mandrel towards the web transport apparatus at a controllable magnitude to create a nip pressure during winding of the tissue web.

9. A process as defined in claim 1, wherein the winding modules are configured to act independently of one another wherein if any winding module is disabled or experiences a process fault, the remaining winding modules are configured to continue winding the tissue web to produce rolled products.

10. A winder for winding a web to produce a rolled product comprising:

a web transport apparatus for conveying a web downstream, the web transport apparatus having a first side and a second opposite side;

a plurality of winding modules positioned along the web transport apparatus, each winding module comprising:

a) a mandrel in operative association with a driving device for center driving and rotating the mandrel, the mandrel extending across the web transport apparatus from the first side to the second side; and b) a positioning apparatus in operative association with the mandrel, the positioning apparatus being configured to move the mandrel into and out of engagement with the web transport apparatus, wherein, when placed in engagement with the web transport apparatus, a nip is formed between the mandrel and the conveyor belt; and wherein each of the mandrels is consecutively positioned and fixed along the web transport apparatus, and wherein the nip between each of the mandrels and the web transport apparatus is used to contact a web being conveyed on the conveyor belt in order to initiate winding of the web on the mandrel.

11. A winder as defined in claim 10, wherein the web transport apparatus has a cylindrical shape and wherein the winding modules are radially disposed with respect to one another along the web transport apparatus.

12. A winder as defined in claim 10, wherein each mandrel is movably positioned so that the distance between the mandrel and the web transport apparatus is varied so as to produce the nip having a nip pressure, a web being wound into a rolled product by combination of mandrel rotational speed, web surface speed, incoming web tension, and the nip pressure.

13. A winder as defined in claim 10, wherein the web transport apparatus comprises a vacuum conveyor belt or an electrostatic conveyor configured to hold a web against a surface of the conveyor belt as the web is conveyed downstream.

14. A winder as defined in claim 10, wherein at least certain winding modules further comprise a core loading apparatus and a product stripping apparatus.

15. A winder as defined in claim 10, wherein at least certain mandrels are vacuum supplied.

16. A winder as defined in claim 10, wherein at least certain winding modules further comprise a tail sealing apparatus for adhering a trailing end of a web onto a roped product.

17. A winder as defined in claim 10, further comprising an adhesive supply device for applying adhesive to a web prior to engagement with one of the winding modules.

* * * * *